United States Patent [19]

Alam

[11] 4,251,897

[45] Feb. 24, 1981

[54] DISPOSABLE TOOTHBRUSH

[76] Inventor: Naveed Alam, 2604 E. 5th Pl. (#9), Tulsa, Okla. 74104

[21] Appl. No.: 19,357

[22] Filed: Mar. 12, 1979

[51] Int. Cl.[3] ..... A46B 1/00

[52] U.S. Cl. ..... 15/167 R; 15/176; 15/227

[58] Field of Search ..... 15/167 R, 227, 202, 15/176

[56] References Cited

U.S. PATENT DOCUMENTS

| | | | |
|---|---|---|---|
| 2,075,681 | 3/1937 | Welker | 15/227 X |
| 2,396,548 | 3/1946 | Allen | 15/227 X |
| 2,517,045 | 8/1950 | Soule | 15/176 |
| 2,668,973 | 2/1954 | Glaza et al. | 15/176 |
| 3,271,805 | 9/1966 | Sawyer | 15/176 |
| 3,321,796 | 5/1967 | Lelicoff | 15/167 R X |
| 3,798,698 | 3/1974 | Conklin | 15/167 R |
| 4,030,845 | 6/1977 | Deckert | 15/167 R X |
| 4,134,172 | 1/1979 | Arce | 15/167 R |

FOREIGN PATENT DOCUMENTS

| | | | |
|---|---|---|---|
| 575672 | 8/1924 | France | 15/227 |

*Primary Examiner*—Christopher K. Moore

[57] ABSTRACT

A disposable toothbrush comprising a tubular member adapted to fit snugly over one finger of the user, or over a handle provided for such purposes, the tubular member having an inner surface comfortable to the user and an outer surface; selected portions of said outer surface having bristles. In another embodiment the toothbrush has a particularly configured disposable brush portion removably attached to a holder portion.

8 Claims, 9 Drawing Figures

9-9

DISPOSABLE TOOTHBRUSH

BACKGROUND OF THE INVENTION

This invention lies in the field of toothbrush and toothpaste assemblies and particularly in the field of disposable toothbrushes.

There has been generally an increasing consciousness among consumers for regular brushing of teeth and for good oral hygiene. Thus various breath deodorizers and breath fresheners, which chemically attempt to overcome the unwanted taste and odor of the mouth, are available on the market. Some have also devised miniature toothbrushes which may be carried by the user in his pocket. The problem with chemicals is obvious, they are short-range measures and do nothing to overcome the basic cause of mouth odor, to-wit, long periods between brushing of teeth. The difficulty with small or miniature toothbrushes is the inconvenience of carrying such items in the pocket. Toothbrushes present another problem insofar that the user has to carry a small tube of toothpaste, with the miniature toothbrush, which has become indispensable in the practical use of toothbrushes.

With the society and the consumers increasingly moving to disposable items where such disposable items are economical, convenient and serve the basic purpose, there is a need to provide disposable toothbrushes. Accordingly, it is an object of this invention to provide a disposable toothbrush which may be economically manufactured and be of a convenient size that the user may carry a number of such disposable toothbrushes in his or her pocket.

It is a further object of this invention to provide a toothbrush which carries with it its own supply of toothpaste or other cleansing means in quantity sufficient for at least one satisfactory brushing of the user's teeth.

It is still another object of this invention to provide a toothbrush which may be disposed by the user after use.

Still further objects and advantages of this invention will be apparent on reference to the accompanying drawings.

SUMMARY OF THE INVENTION

These and other objects are realized and the limitations of the toothbrushes and the chemical agents on the market are overcome by providing a toothbrush comprising a tubular member having an inner surface and an outer surface; the inner surface being comfortable to the user, the outer surface having selected portions thereof provided with bristles comprising a plurality of tufts of fiber arranged in a selected manner; the tubular member adapted to fit over portions of one finger or the thumb of the user; the tubular member being preferably made of elastic material and collapsible to a convenient size and may be marketed in individual sanitized packets. The cleansing action is accomplished by the use of toothpaste or other chemical agents provided within the bristles of the toothbrush or is carried in a pouch interposed between the user's finger and the inner surface of the tubular member.

In another embodiment of this invention the tubular member is a C-shaped body; or the entire outer surface is provided with bristles.

Other embodiments of this invention use a handle instead of a finger of the user and another embodiment uses a collapsible handle with a disposable brush piece.

DESCRIPTION OF THE PREFERRED EMBODIMENT

Figure 1:
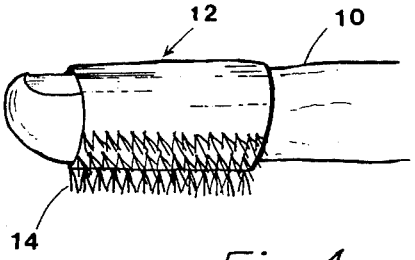
FIG. 1 is a perspective view of the disposable toothbrush fitted over one finger of a user.

Referring now to FIG. 1 the present invention is illustrated in its operative configuration. Reference 10 generally indicates one finger of the user and 12 represents generally the device of the present invention. As shown the present device 12 generally comprises a tubular member formed of an elastomeric material and fits snugly over portions of one finger of the user. Selected portions of the device 12 being provided with bristles 14.

Figure 2:
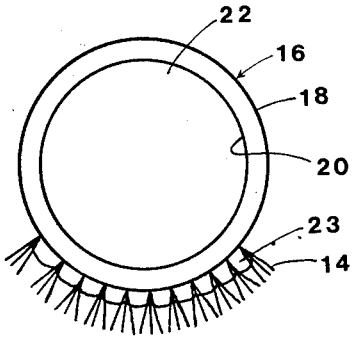
FIG. 2 is a sectional view of the device of the present invention.

A better understanding of the mechanism can be obtained by reference to FIG. 2. As illustrated, the device 12 comprises a tubular member 16 having an outer surface 18 and an inner surface 20. The inner surface 20 is comfortable to the touch of the user; the outer surface 18 has selected portions thereof provided with bristles or projecting tufts of fiber 14 extending outwardly to form the brush portion of the present device. The finger in cross section is represented by reference 22.

The tubular member 16 is preferably made from elastomeric material such as elastic, rubber, or other materials well known in the art. The material is chosen such that the device 12 may be collapsed into small packages for easy marketing as well as carrying on the person by the user.

It is well known that one difficulty with miniature or small toothbrushes is that a supply of toothpaste is essential and is usually carried separately in small tubes. However the present invention contemplates that a supply of toothpaste or other similar chemical agents be provided in sufficient quantity with the device so that the device 12 in and of itself should be sufficient for purposes of brushing the teeth of the user. In FIG. 2 reference 23 represents a supply of toothpaste or similar chemicals provided in the bristles 14 adjacent the outer surface 18. The chemical 23 may be in dried powder form of semi-solid and is retained in position by the juxtaposition of adjacent columns and rows of the bristles, as shown.

Figure 4:
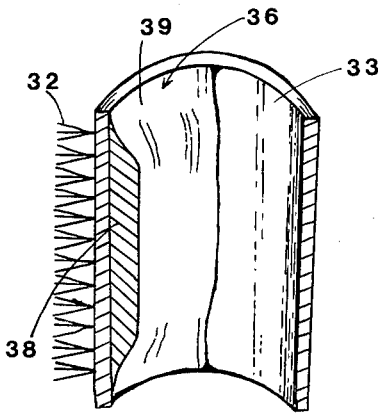
FIG. 4 is a sectional view of the embodiment of FIG. 3.
Figure 3:
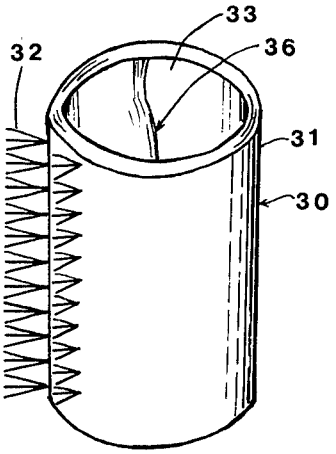
FIG. 3 is a perspective view of a second embodiment of the present device.

Another embodiment of the present invention is shown in FIG. 3 which differs from the embodiment in FIG. 2 by providing a supply of chemical agent or toothpaste in liquid or non-solid form. Here the tubular member 30 has selected portions thereof provided with tufts of fiber or bristles 32 on the outer surface 31 thereof. For practice of this embodiment, it is required that the portions of the tubular member 30 having the bristles 32 be permeable or in other words liquid provided on the inner surface 33 thereof be free to travel outwardly and mingle with the bristles. This is shown more clearly in the sectional view of FIG. 4, where the inner surface 33 is provided with a pouch 36 substantially aligned with the bristles 32 and containing toothpaste or like substances 38, as shown. The pouch 36 is formed by providing a second layer of material 39 attached at its peripheral edges to the inner surface 33. It can be seen that when the user slips the tubular member 30 on his finger the pressure thus applied would force the chemical 38 contained in the pouch 36 through the tubular member inner surface 33 and through the outer surface 31 and push it outwardly to mingle with the bristles 32. In this manner toothpaste in sufficient quantity for purposes of the process of brushing teeth may be provided.

Figure 5:
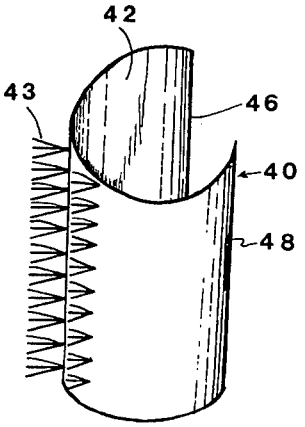
FIG. 5 is the third embodiment of the present invention.

Referring now for a moment to FIG. 5 another embodiment of the present device is shown and comprises a substantially C-shaped member 40 of dimensions substantially equal to the tubular members described previously. This member 40 may be formed of rigid or semi-rigid material, such as plastic, polyesters or reinforced fiber. The inner surface of the member 40, represented by 42, is made comfortable to the touch of the user and the outer surface is provided with bristles or tufts of fiber 43. For this embodiment, although not shown in FIG. 5, a supply of teeth cleaning chemical agents may be provided either as shown in FIG. 2 or as shown in the embodiment illustrated in FIG. 3. To use this device the user slips the member 40 on his finger and uses it in the same manner as the device in FIG. 1. The member 40 may be made of deformable material such that the user may merely press the longitudinal edges 46, 48 to secure the member 40.

It will be seen that this embodiment of FIG. 5 may be economical to make because it requires less material and may be useful in conjunction with embodiments still to be described.

It should be noted that in the embodiments shown the bristles are described as tufts of fiber and illustrated as being positioned in rows and columns. However, the shape or size and manner of attachment of the bristles is not within the claims as many changes may be made; for example the bristles may be merely loops of fibers projecting outwardly and arranged differently; also, instead of having selected outer surface of the embodiment provided with bristles, the entire surface may be so provided. This of course is apparent, but is mentioned here for clarity.

Figure 6:
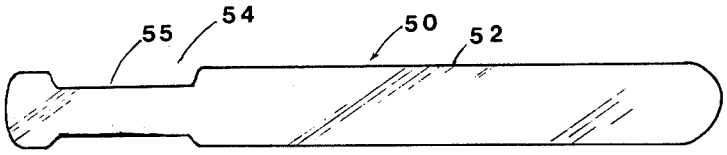
FIG. 6 illustrates another manner of using the present device by using a holder.

It is well known that in many cultures it is not customary to brush teeth with one's finger or for a person to introduce his finger in his mouth. Accordingly, the present invention contemplates that a toothbrush holder be provided for the disposable toothbrushes described above. Referring now to FIG. 6 a toothbrush holder for the toothbrushes described above is generally indicated by 50 and comprises an elongated member 52 having a first end 54 configured to receive and hold securely the toothbrush 12 in one of its embodiments. The first end 54 has a portion 55 thereof, of sufficient length to receive toothbrush 12, made of reduced dimension as shown. The device 12 slips over the holder 50 and is anchored in portion 55. For example, the embodiment of FIG. 5 may be positioned in portion 55 and the longitudinal edges 46, 48, thereof deformed or pressed by the user to securely hold the device 12 in place. The embodiments illustrated in FIGS. 1 and 3 may be anchored in portion 55. It will be apparent that instead of making the portion 55 of reduced dimensions, it may be dimensioned to be greater or larger than the remaining portions of the handle 50.

By use of the holder 50 the user need not introduce his finger in his mouth and may still be able to maintain oral hygiene by brushing of teeth. After use the holder 50 may be retained or disposed of, depending on the cost thereof. It can be seen that it will be possible to clean the holder 50 very easily, as there are no inaccessible crevices or portions.

Figure 7:
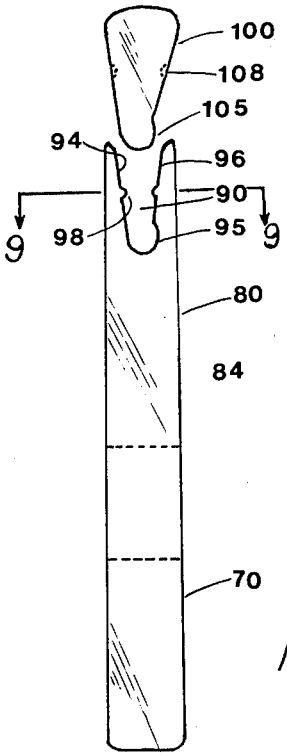
FIG. 7 illustrates a different mechanism for achieving a disposable toothbrush.
Figure 10:
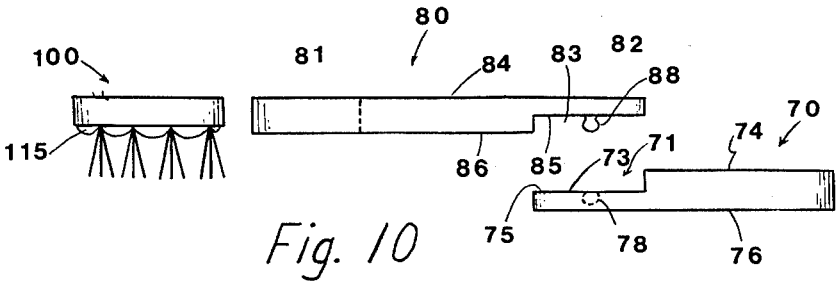
FIG. 10 is a side elevational view of the components of the disposable device of FIG. 7 and illustrates the manner of their attachment.

Turning now to FIG. 7, therein is illustrated another method of obtaining a disposable toothbrush while having no inaccessible portions. As shown, this embodiment comprises an extension piece 70, a toothbrush holder piece 80, and a detachable toothbrush piece 100. Extension piece 70 is a longitudinal member configured to attach securely with the toothbrush holder piece 80 in an interlocking manner. This is achieved by making selected portion 73 of the first end 71 of the extension piece 70 of a reduced height as shown in FIG. 10. The upper surface of extension piece 70 is designated by the reference numeral 74, the lower surface by 76; the upper surface of the first end is designated 75. The surface 75 has a recessed portion 78, said recess portion 78 being substantially arcuate in cross-section as illustrated in FIG. 10 and preferrably somewhat greater than one-half circle for purposes that will be apparent. The toothbrush holder piece 80 has a first end 81 and a second end 82; selected portion 83 of the second end 82 is of a reduced height and said portion 83 being substantially equal to the dimensions of portion 73 such that when said second end 82 is placed on top of surface 75 the top surface 84 is in the plane of the surface 74 and similarly the bottom surface 86 is in the plane of the surface 76. The lower surface 85 of portion 83 is provided with an anchor or projection 88 projecting outwardly therefrom, the shape of said projection 88 being substantially equal to a semi-circle and preferably greater than a half-circle and is made to conform to the particular shape of the groove 78. It can be seen that when the surface 85 is placed on top of the surface 75 the projection or anchor 88 is aligned with the groove 78 and on applying pressure on surface 86 the anchor 88 is forced into the groove 78 and is held securely in position therein.

Figure 9:
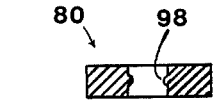
FIG. 9 is a sectional view of one of the components of the device of FIG. 7.

The first end 81 will now be described in greater detail. Referring to FIG. 7, the first end 81 has a V-shaped notch 90 therein; said notch 90 having a first surface 94 and a second surface 96. The second surface 96 has at its lower end a groove 95 extending beyond the surface 96, said groove 95 being preferrably arcuate in configuration. The surfaces 94 and 96 are provided with anchors or projections 98 extending outwardly and situated substantially mid-way between the lower and the upper end of the V-notch 90. The function and purposes of the anchors 98 and the arcuate groove 95 will be clearer on further description of the embodiment; they are shown in greater detail in the sectional view of FIG. 9.

Referring again to FIG. 7 the toothbrush piece 100 is shown configured to be fitted in the notch 90 in an interlocking relationship. The piece 100 is substantially V-shaped also and has a top surface 104, bottom surface 106 and edge surface 107. At the lower end an arcuate projection 105 conforming to the particular shape of the groove 95 is provided. Arcuate grooves 108 are also provided on the edge surface 107; said arcuate grooves 108 conforming in shape to the projections or anchors 98. The upper surface 104 of said piece 100 is planar such that when said piece 102 is positioned within the V-notch 90, said surface 104 lies in the plane of the surface 84. The lower surface 106 of the piece 100 is provided with bristles or tufts of fibers 110 as better illustrated in FIG. 8.

It will be seen that in the present embodiment the toothbrush is in three different pieces 70, 80 and 100, and thus may be conveniently carried in the pocket or in a carrying case by the user. When the user needs to use the toothbrush the three different pieces 70, 80 and 100, are attached in the manner shown in FIG. 7 and FIG. 8. The extension piece 70 attaches to the holder piece 80 with the projection or anchor 88 forced into the groove 78; next the toothbrush piece 100 is fitted in the V-notch 90 with the portion 105 resting in the groove 95 and anchors 98 resting in grooves 108. Thus the toothbrush is ready for use and after use may be disposed of completely or the toothbrush piece 100 only may be disposed of while the extension piece 70 and the holder piece 80 may be retained by the user. After use, the area around the V-notch 90 is generally expected to be unclean, and as can be seen all areas around the notch 90 are easily accessible and may be readily cleaned by the user; if it is desired that the holder piece 80 be retained. Thus with this embodiment the user may have a sufficient supply of toothbrush pieces 100 only for multiple use of extension piece 70 and the holder piece 80.

Figure 8:
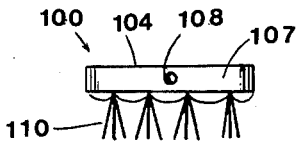
FIG. 8 is a side elevational view of one components of the device of FIG. 7.

It is contemplated that brush piece 100 be provided with a supply of toothpaste or other teeth cleaning chemicals 115 securely positioned within the bristles in power form or in semi-dried form as shown in FIG. 8. Thus it will be unnecessary that the user carry a supply of teeth cleaning chemicals to brush teeth.

It will be apparent that this invention would enable the disposable toothbrushes, as shown in FIGS. 1, 3 and 5 and the brush piece 100 in FIG. 7, to be marketed in individual sanitized packets and the user may carry a number of such toothbrushes on his person, and brushing of teeth may be accomplished anywhere and at any time. The present device is a particular improvement over devices on the market in that the user may employ his fingers as a brush holder, or use a handle particularly provided. Also, the user need not carry a separate supply of teeth cleaning agents, like toothpaste, as the invention contemplates that sufficient supply be provided with each disposable toothbrush. In this manner this invention promotes oral hygiene and the conscious person can avoid polluting his ambient environment with noxious odor emanating from his mouth. This will be greatly appreciated by the associates of the user.

Whereas the present invention has been described in particular relation to the drawings attached hereto, it should be understood that other and further modifications apart from those shown or suggested herein may remain within the spirit and scope of this invention. It is understood that this invention is not restricted to the particular drawings shown herein but is to be restricted and limited only by the claims and each element be entitled to the full range of equivalency that it is entitled to.

What is claimed is:

1. A disposable toothbrush comprising:

a unitary elastomeric tubular member having a deformable body, a first open end and a second open end, a uniform inner dimension, an inner surface and an outer surface; the outer surface having selected portions thereof provided with brush means; said tubular member having sufficient elasticity to self-adjust and fit securely over selected length of differently dimensioned user's finger when said finger is positioned within said tubular member by insertion through the first open end and out through the second open end; the tubular member deforming, along its length, to snugly engage the contour of the finger.

2. A disposable toothbrush as in claim 1 wherein said selected portions of outer surface comprise the entire outer surface.

3. A disposable toothbrush as in claim 1 wherein the brush means are provided, intertwined therewith, particular chemicals.

4. A disposable toothbrush as in claim 1 wherein a pouch is provided interiorly of the tubular member, said pouch attached at its peripheral edges to the inner surface substantially aligned with said brush means; said pouch containing particular chemicals; the portion of the outer surface provided with brush means being imperforate and the material of said outer surface being permeable to said chemicals to allow flow of said chemicals therethrough when a finger is positioned within said toothbrush.

5. A disposable toothbrush as in claim 1 wherein the tubular member is a C-shaped member having two longitudinal edges; said edges deformable to cause the C-shaped member to securely grip the user's finger.

6. A disposable toothbrush as in claim 1 and further including a holder member substitutable for the user's finger, said holder being substantially elongated member having first end paticularly configured and adapted to receive and securely hold said disposable toothbrush.

7. A toothbrush comprising a toothbrush holder and a disposable brush piece;

the toothbrush holder piece comprising a substantially elongated member having a first end and a second end; the first end having a V-shaped notch therein, said V-shaped notch provided with an arcuate groove and at lease one outwardly protruding anchor;

the disposable brush piece comprising a substantially V-shaped body attaching to said V-shaped notch; the V-shaped body having an arcuate projection dimensioned in relation to said arcuate groove and at least one groove dimensioned in relation to said anchor; the V-shaped body provided with bristles on at lease one surface;

the brush piece adapted to removeably attached to said toothbrush holder piece with said arcuate groove receiving said arcuate projection and said groove receiving said anchor.

8. A toothbrush as in claim 7 and further including an extension piece attaching to said second end; said second end provided with an outwardly extending projection; the extension piece comprising an elongated body having at one end a groove configured in particular relation to said projection;

the extension piece adapted to attach to said second end with said projection residing in said groove.

* * * * *